US005770159A

United States Patent [19]

Marteau D'Autry

[11] Patent Number: 5,770,159

[45] Date of Patent: Jun. 23, 1998

[54] PIPETTE FOR DISPENSING SUCCESSIVE VOLUMES OF LIQUID

[76] Inventor: Eric Marteau D'Autry, 1 rue Boutarel, 75004 Paris, France

[21] Appl. No.: 793,161

[22] PCT Filed: Aug. 16, 1995

[86] PCT No.: PCT/FR95/01084

§ 371 Date: Feb. 11, 1997

§ 102(e) Date: Feb. 11, 1997

[87] PCT Pub. No.: WO96/04991

PCT Pub. Date: Feb. 22, 1996

[30] Foreign Application Priority Data

Aug. 16, 1994 [FR] France ..... 94 10035

[51] Int. Cl.[6] ..... B01L 3/02

[52] U.S. Cl. ..... 422/100; 73/864.02; 73/864.13; 73/864.16; 73/864.87; 222/287; 222/309; 222/631

[58] Field of Search ..... 422/100; 73/864.02, 73/864.13, 864.16, 864.87; 222/631, 287, 309

[56] References Cited

U.S. PATENT DOCUMENTS

| | | |
|---|---|---|
| 2,534,857 | 12/1950 | Crewe . |
| 4,033,484 | 7/1977 | Ornsteen . |
| 4,249,419 | 2/1981 | Thomas . |
| 4,339,058 | 7/1982 | Wendt . |
| 4,467,942 | 8/1984 | Oshikubo . |
| 4,589,870 | 5/1986 | Citrin et al. . |
| 4,967,604 | 11/1990 | Arpagaus et al. . |

FOREIGN PATENT DOCUMENTS

| | | |
|---|---|---|
| 562263 | 6/1990 | Belgium . |
| 656229 | 6/1995 | European Pat. Off. . |
| 2432161 | 2/1980 | France . |
| 1011470 | 12/1965 | United Kingdom . |

*Primary Examiner*—Jan Ludlow
*Attorney, Agent, or Firm*—Mason, Kolehmainen, Rathburn & Wyss

[57] ABSTRACT

The invention relates to a pipette for dispensing successive volumes of liquid by repeated action on a pusher (22). A drive lever (26) is provided to drive a pushrod (15) and a piston rod (5) downwards only. The lever (26) extends transversely to the longitudinal axis (X) of the thrust rod (15) and it includes a hole (27) through which the pushrod (15) passes with a small amount of clearance. The pusher (22) can act on one end of the lever (26) to cause it to tilt relative to the pushrod (15) and then to drive the pushrod downwards by wedging, together with the piston rod (5), and to expel a predetermined volume of liquid. The lever (26) is mounted to rotate about a tilt axis (Y) that intersects the axis of the hole (27) perpendicularly substantially halfway along the hole.

7 Claims, 8 Drawing Sheets

PIPETTE FOR DISPENSING SUCCESSIVE VOLUMES OF LIQUID

FIELD OF THE INVENTION

The present invention relates to a pipette for dispensing successive volumes of liquid by repeated action on a pusher.

BACKGROUND OF THE INVENTION

French patent application No. 2 432 161 describes a pipette comprising a housing of oblong shape incorporating a mechanism for adjusting the volume to be dispensed, and a syringe for fixing removably to the bottom end of said housing. A piston suitable for moving in sealed manner inside the syringe body is mounted at the bottom end of a pushrod capable of sliding longitudinally through the housing. In order to dispense a predetermined volume of liquid, the pushrod is driven downwards by action on a pusher via a drive lever that is capable of moving over a predetermined stroke between a fixed bottom abutment and an adjustable top abutment. The lever comprises a first portion pierced by a hole enabling the pushrod to pass therethrough with small clearance, and a second portion extending transversely to the axis of said hole. The pusher is disposed to exert a pressure force in the vicinity of the free end of the second portion of the lever, and by a wedging effect to drive the thrust rod. The lever is also subjected to upwards resilient biasing so as to ensure that it returns automatically to its rest position against the top abutment when the pusher is released. That type of pipette has given satisfaction. However, in the long run, wear on the various component parts of the pipette gives rise to reduced accuracy.

SUMMARY OF THE INVENTION

An object of the present invention is to propose a novel pipette presenting greater accuracy than known pipettes, even after prolonged use.

The pipette of the invention is of the type comprising:

a housing of oblong shape, incorporating a mechanism for adjusting the volume of liquid to be dispensed;

a syringe for mounting removably to one end of the housing, comprising a syringe body provided with a fluid-passing orifice and a piston rod mounted to move inside said syringe body;

a thrust rod mounted to slide longitudinally in the housing, and to be removably connected at one end to said piston rod;

a drive lever for driving the thrust rod and the piston rod solely towards said liquid-passing orifice, the lever extending transversely to the longitudinal axis of the thrust rod and being provided with a hole through which the thrust rod passes with a small amount of clearance, the lever also being mounted with the ability to move inside the housing over a stroke that is adjustable in the longitudinal direction of the thrust rod between a rest position defined by an adjustable abutment of the adjustment mechanism and an end-of-stroke position defined by a fixed abutment, and being returned towards said rest position by resilient return means; and said pushbutton being mounted to slide longitudinally inside the housing, being provided at one end extending outside the housing with a pushbutton and being capable of acting via its other end on the lever to tilt it obliquely relative to the thrust rod and then to drive the thrust rod by wedging towards the fluid-passing orifice together with the piston rod so as to expel a predetermined volume of liquid as defined by the stroke of the lever between said rest position and said end of stroke position, return movement of the lever towards its rest position after each action on the pushbutton taking place under drive from said resilient return means while the piston rod retains its position within the body of the syringe.

In characteristic manner, the lever is mounted to rotate about an axis that intersects the axis of said hole perpendicularly and substantially halfway along the hole.

Thus, however much the clearance for the rod in the hole through the lever may increase due to wear, the lever continues to tilt about the same geometrical axis of rotation until the thrust rod is wedged in the hole; if there is considerable wear, then the lever tilts further, but unlike known pipettes, that has no effect on the stroke of the thrust rod. In known pipettes, the lever is not guided during its tilting movement and said movement can be accompanied by a small amount of sliding over the thrust rod, with the result that the thrust rod is not driven over the full distance defined by the difference between the fixed and adjustable abutments, with the result that the accuracy of the pipette is reduced.

Advantageously, the lever is disposed on the thrust rod between a bottom sleeve and a top sleeve slidably mounted on the thrust rod, and the lever has two surfaces of revolution centered on said tilt axis, said surfaces being disposed on either side of said hole and being in contact with the top and bottom sleeves. The bottom sleeve comes into abutment against said fixed abutment when the lever reaches its end-of-stroke position.

Advantageously, said surfaces of revolution are formed by balls crimped in holes through the lever.

Advantageously, said pusher includes a sheath slidably mounted inside the housing and within which the pushrod is free to slide. It is provided at one end with a contact piece having a sharp edge designed to press on the lever to tilt it about said tilt axis and then to move it along the longitudinal direction of the thrust rod.

Advantageously, the adjustment mechanism includes an adjustment screw for rotating in order to adjust the stroke of the lever and the volume dispensed each time the pusher is actuated. This adjustment screw has the sheath and the pushrod passing through the inside thereof, and meshing with a volume-indicator mechanism. The adjustment screw has an end edge that defines said variable abutment, and the top sleeve has an end edge suitable for coming into point contact therewith.

Advantageously, the pushbutton includes a first portion slidably mounted over a second portion, with a first return spring being interposed therebetween. A second return spring of stiffness constant smaller than that of the first return spring is resiliently interposed between the housing and said second portion to return the pusher resiliently away from said liquid-passing orifice. The stiffness constant of said resilient return means urging the lever towards its rest position is smaller than the stiffness constants of the first and second return springs.

Advantageously, the syringe and the piston rod are removably fixed to the housing of the pipette by means of a clamp in the form of a part whose top portion is secured to the bottom end of the thrust rod, whose middle portion includes a recess suitable for receiving the free top end of the piston rod, and whose bottom portion includes resilient branches enabling the piston rod to be inserted therein and to be held thereby, and the bottom end of the housing includes means suitable for removably securing the body of the syringe while leaving the clamp and the piston rod free to slide Advantageously, the middle portion of the clamp includes a recess defined by the free top faces of the clamps, by a transverse surface, and by a longitudinal surface.

BRIEF DESCRIPTION OF THE DRAWINGS

Other characteristics and advantages of the present invention appear on reading the following detailed description of non-limiting embodiments of the invention, and on examining the accompanying drawings, in which.

DETAILED DESCRIPTION OF THE PREFERRED EMBODIMENT

In the description below, the terms "bottom" and "top" are used to describe the pipette when in its generally vertical in-use position.

Figure 1:
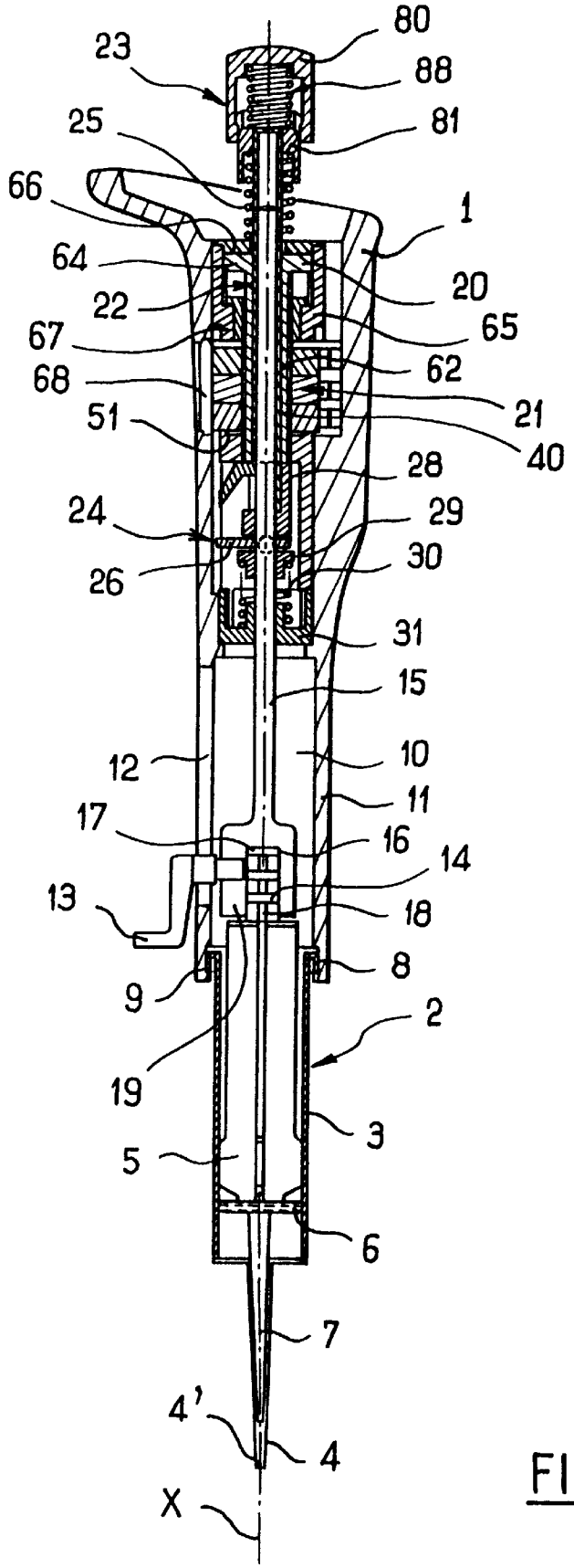
FIGS. 1 and 1*a* are longitudinal section views through two different embodiments of a pipette of the invention.

The pipette of the invention as shown in FIG. 1 comprises a housing 1 of plastics material, of oblong shape and suitable for being grasped by a user. A syringe 2 is removably mounted at the longitudinally bottom end of the housing 1 to take and to dispense successive volumes of liquid. The syringe 2 has a body 3 that is generally circularly cylindrical about an axis X, and that is extended downwards by a frustoconical end-piece 4 having an open end 4' for passing liquid. A piston rod 5 of plastics material is mounted to slide in sealed manner inside the body 3, with sealing being provided by an annular lip 6 situated in the bottom portion of the piston rod 5. Beyond the lip 6, the piston rod has a conical bottom end 7 shaped to engage in the frustoconical end-piece 4 so as to expel liquid contained therein as completely as possible when the piston rod 5 reaches its bottom end-of-stroke position. The top end 8 of the body 3 has an outwardly projecting flange which is retained in an annular groove 9 in the housing 1 by swelling or by any other equivalent disposition enabling the syringe and piston assembly to be mounted and dismounted easily on the open bottom end of the housing 1.

A particularly advantageous embodiment of a fixing part enabling the assembly comprising the syringe 2 and the piston rod 5 to be mounted and dismounted, both simultaneously and rapidly, is described below in greater detail with reference to FIGS. 1*a*, 11, 12 and 13.

The annular groove 9 is formed in the radially inside surface of a receptacle 10 which is generally circularly cylindrical about the axis X, which is formed in the bottom portion of the housing 1, and in which the piston rod 5 of the syringe 2 can rise while liquid is being taken. The wall 11 of the housing 1 that defines the receptacle 10 is generally circularly cylindrical about the axis X, and it is open parallel to the axis X along a fraction of its length so as to form a longitudinal slot 12 for passing a drive finger 13 for driving the piston rod 5 in a manner described below.

The top end of the piston rod 5 has a coupling portion 14 releasably connected to the bottom end of a thrust rod 15 mounted to slide longitudinally inside the housing 1 along the axis X.

The top portion of the thrust rod 15 is slidably mounted in the housing 1 and is circularly cylindrical about the axis X, while its bottom end flares to form a circularly cylindrical receptacle 16 about the axis X for the purpose of receiving the coupling portion 14 of the piston rod 5. This coupling portion 14 is ringed, presenting a sequence of three friction disks 17 of the same diameter and uniformly spaced apart along a core 18 of smaller diameter than the disks 17. The coupling portion 14 is retained inside the receptacle 16 by friction. The drive finger 13 is fixed to the wall 19 of the thrust rod 15 where it defines the receptacle 16, and it passes through the slot 12.

Figure 1A:
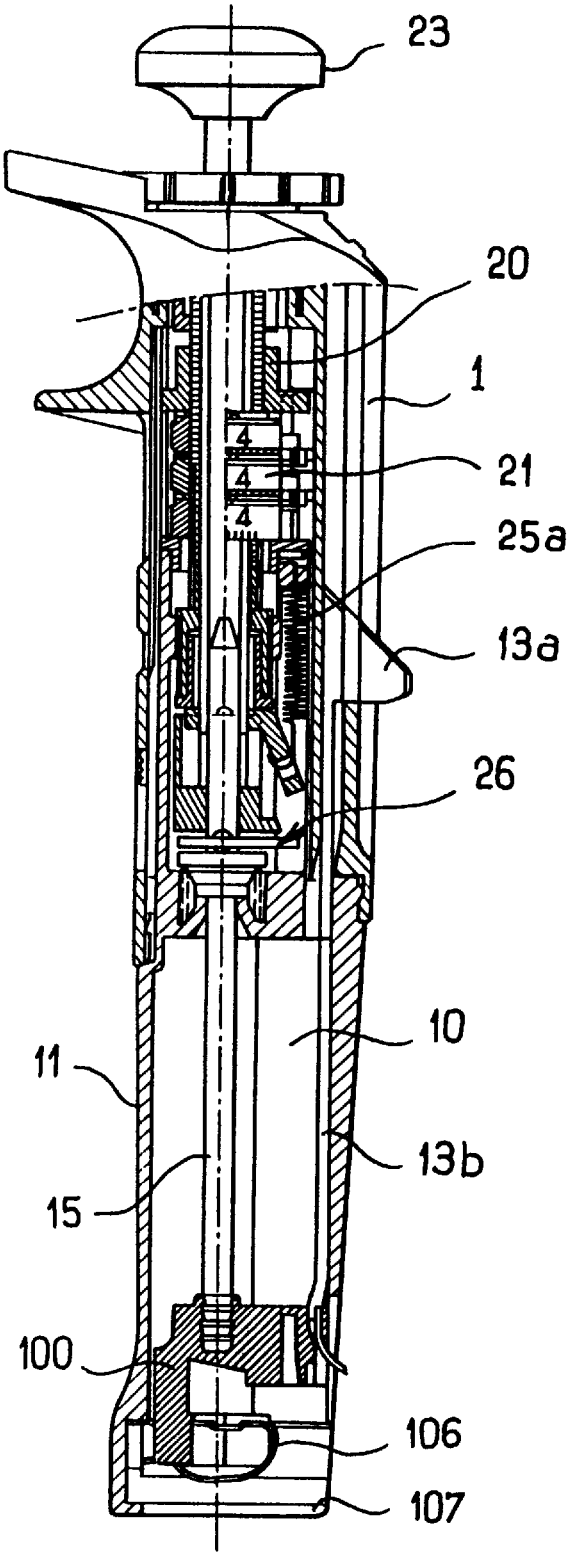

In the embodiment shown in FIG. 1*a*, the drive finger 13*a* is raised towards the top portion of the housing 1 so as to facilitate access to the drive finger 13 by a user manipulating the pipette with one hand only. As can be seen in FIG. 1*a*, that naturally assumes the finger 13*a* extends inside the housing in the form of a kind of strip 13*b* connecting it to the part for controlling and fixing the tail of the piston. The bottom portion of the strip 13*b* is terminated by a tongue of bright color that becomes visible outside the housing at the end of the pipette stroke, i.e. when the body of the syringe 2 is about to be completely emptied.

The top portion of the housing 1 contains a mechanism 20 for adjusting the volume to be dispensed, which mechanism is described in greater detail below. It also contains an assembly 21 coupled to the adjustment mechanism 20 for indicating said volume. A pusher 22 comprising a metal sheath 40 fitted at its top end with a pushbutton 23 is slidably mounted inside the housing 1 on the axis X so as to enable the user to dispense successive volumes of liquid by repeated downward presses on the pushbutton 23.

Each time the user exerts pressure on the pushbutton 23, the sheath 40 moves down and, via a one-way transmission 24, drives the thrust rod 15 and the piston rod 5 downwards, i.e. towards the liquid-passing orifice 4' so as to dispense liquid, whereas the upward return movement of the sheath 40 takes place solely under drive from resilient return means constituted solely by a helical spring 25 and independently of the thrust rod 15 and the piston rod 5, each of which remains in the same position inside the housing 1 and inside the body 3 of the syringe 2 under the effect of the friction exerted by the lip 6 on the body 3 of the syringe 2.

In the embodiment of FIG. 1*a*, the resilient return means are implemented in the form of a helical spring 25*a* which does not work in compression like the spring 25, but which works in traction.

Figure 2:
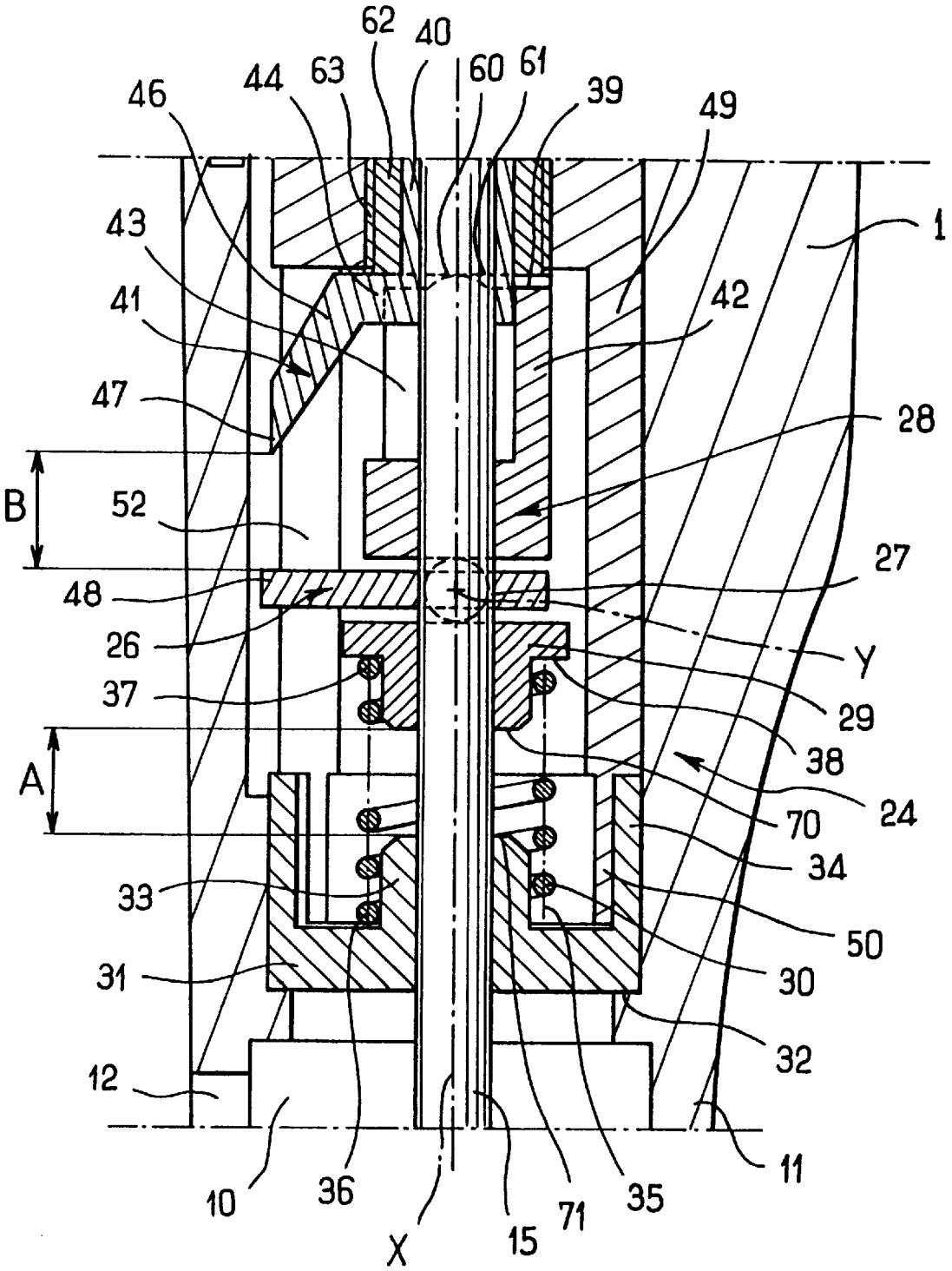
FIG. 2 is a fragmentary longitudinal section through the pipette shown in FIG. 1, but on a larger scale.

The one-way transmission 24 that is now described more particularly with reference to FIG. 2 includes a lever 26 extending generally transversely to the axis X, and having a central circular hole 27 through which the thrust rod 15 passes with a small amount of clearance. This small clearance allows the lever 26 to move between a rest position where the axis of the central hole 27 is substantially parallel to the axis X (thus enabling the lever 26 to move freely over the thrust rod 15) and a position that is downwardly oblique relative to the axis X (to drive the thrust rod 15 by a wedging effect).

The drive lever 26 is disposed on the thrust rod 15 between a top sleeve 28 and a bottom sleeve 29, both of which are slidably mounted thereon. A helical spring 30 working in compression is placed between the bottom sleeve 29 and a ring 31 that serves as a fixed abutment, and that is retained axially against an inside shoulder 32 of the housing 1. The bottom face of the ring 31 closes the receptacle 10, while its side facing away from the housing has a central portion 33 which is circularly cylindrical about the axis X, which has a bore for passing the thrust rod 15, and it also has a wall 34 that is circularly cylindrical about the axis X and that co-operates with the central portion 33 to form an upwardly open annular groove 35. The wall 34 has its radially outer surface in contact with the housing 1.

The bottom end 36 of the helical spring 30 bears axially against the bottom of the annular groove 35, while its top end 37 bears against a shoulder 38 on the bottom sleeve 29. The sheath 40 of the pusher 22 is circularly cylindrical about the axis X, and the metal thrust rod 15 is freely slidable therein.

The bottom end of the sheath 40 is extended by a contact part 41 designed to bear against the lever 26 so as to tilt it and then, after wedging against the thrust rod 15, so as to displace the lever 26 along the axis X together with the thrust rod 15. The contact part 41 has a first portion 44 connected at one end to the sheath 40 and extending radially outwards perpendicularly to the axis X over a distance that is greater than the outside radius of the sheath 40, so as to connect to a second portion 46 that extends obliquely downwards away from the axis X, forming an angle of about 45° therewith. The bottom end of the second portion 46 has a sharp edge 47 designed to exert pressure in the vicinity of the radially outermost free end 48 of the lever 26 (outermost in the plane of the section of FIGS. 1 and 2). The top sleeve 28 is generally circularly cylindrical about the axis X; it has a bore running from its top end edge 39 and along more than half of its length for the purpose of receiving the bottom end of the sheath 40. The wall 42 of the top sleeve 28 defining the bore designed to receive the sheath 40 has an opening in its periphery that forms a longitudinal slot 43 through which the contact part 41 passes.

The assembly constituted by the lever 26 and the top and bottom sleeves 28 and 29 moves inside a guide part 49 that is generally tubular about the axis X, that is downwardly open and closed at the top, apart from tapping 63 centered on the axis X and suitable for receiving a hollow adjustment screw 62 within which the sheath 40 and the thrust rod 15 can slide. The guide part 49 has a shouldered bottom end 50 engaging in the annular groove 35 of the ring 31, in contact with the radially inner surface of the wall 34 until the shoulder comes into abutment against the top edge of the wall 34. The top end edge 51 of the guide part 49 comes to bear against the volume-indicating assembly 21. The guide part is open along its entire length so as to form a guide slot 52 for the portion 46 of the contact part 41 and for the end 48 of the lever 26, thereby ensuring that they are held by the guide part 49 in substantially vertical mutual relationship; this ensures that when the sheath 40 moves downwards, the edge 47 always comes to bear against the end 48 of the lever 26.

Figure 3:
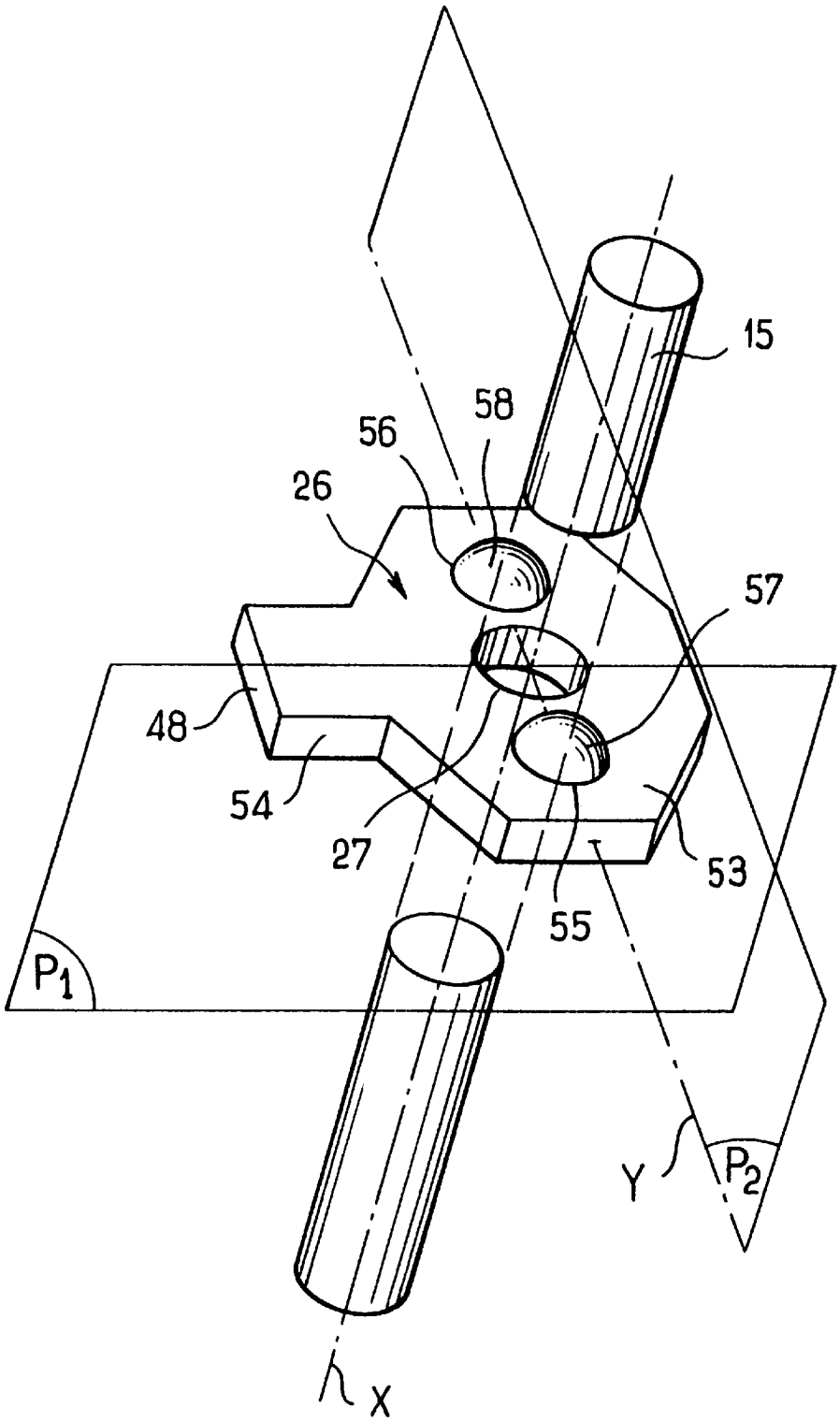
FIG. 3 is a perspective view of the drive lever through which the thrust rod passes.

In FIG. 3, the lever 26 and the thrust rod 15 are shown in perspective. The lever is mainly constituted by a plate extending perpendicularly to the axis of the central hole 27, having a first portion 53 with the central hole 27 passing through the center thereof to allow the thrust rod 15 to pass through with a small amount of clearance, and a second portion 54 that extends the first portion 53 laterally so as to act as an abutment for the contact part 41. Two holes 55 and 56, situated on either side of the central hole 27, pass through the central portion 53, with each of them serving to receive a respective ball 55 or 57 that is held in the plate by crimping. The plane $P_2$ containing the axis of the central hole 27 and the axes of the holes 55 and 56 containing the balls 57 and 58 extends perpendicularly to a mid-plane $P_1$ of the lever 26, likewise containing the axis of the central hole 27 and extending in a direction towards the second portion 54 of the lever 26. In the example described, the section of the second portion 54 in a plane parallel to the plane $P_2$ is rectangular in shape.

The balls 57 and 58 are axially interposed between the bottom sleeve 29 and the top sleeve 28, and they constitute guide means for guiding tilting of the lever 26 when the contact part 41 extending the sheath 40 downwards bears against the end 48 of the second portion 54. This tilting takes place about an axis of rotation Y that intersects the axis X perpendicularly, substantially halfway along the central hole 27. In accordance with the invention, more or less marked clearance due to wear in the passage provided for the thrust rod 15 by the central hole 27 of the lever 26 gives rise to the lever 26 tilting to a greater or lesser extent about its axis of rotation Y, until the thrust rod 15 wedges against the edges of the central hole 27. The axis of rotation Y of the lever 26 remains stationary throughout the tilting of the lever.

The top end wall 39 of the top sleeve 28 has an upwardly convex projection 60 whose apex defines point contact with the bottom end edge 61 of the adjustment screw 62. The sheath 40 passes through the inside of the screw, as mentioned above, and the outside of the screw is threaded so that its bottom portion engages the tapping 63 in the guide part 49. The assembly constituted by the adjustment screw 62 and the guide part 49 constitutes the above-mentioned mechanism 20 for adjusting the volume to be dispensed by serving to vary the downward stroke of the lever 26, and thus that of the thrust rod 15 and of the piston rod 5, each time the pusher 22 is actuated, as is described in greater detail below. The top end of the adjustment screw 62 has a collar 64 that is accessible to the user from outside the housing 1 via openings formed in the housing 1 and not shown. The radially outer surface of the collar 64 is advantageously knurled so as to facilitate manual rotation of the adjustment screw 62 by the user. A brake may also be applied to the adjustment screw 62 so as to exert a friction force relative to the housing 1 and prevent untimely loss, in use, of the adjustment of the volume as selected by the user. The collar 64 of the adjustment screw 62 rotates inside a part 65 that is generally circularly cylindrical about the axis X and that is provided with openings designed to come into coincidence with the openings in the housing 1 so as to give access to the collar 64 from the outside. A closure washer 66 is applied to the top end edge of the part 65. The bottom portion of the part 65 is pierced to receive a nut 67 through which the adjustment screw 62 passes.

The indicator assembly 21 is known per se and is not described in detail. In the example shown, it is of the type comprising three drums for indicating the volume to be dispensed, which drums are juxtaposed and mesh in one another and with the adjustment screw 62 in conventional manner. The volume to be dispensed is indicated to the user by the drums via a transparent window 68.

The operation of the pipette is now described more particularly with reference to FIGS. 4 to 7.

Figure 4:
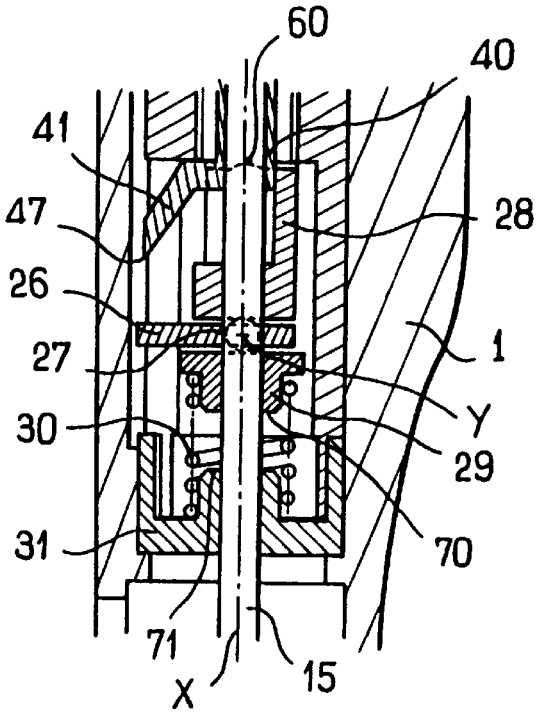
FIGS. 4 to 7 show successive positions of the drive lever while the pipette is in use.

FIG. 4 shows the drive lever 26 in its rest position. The top sleeve 28 comes into axial abutment via the projection 60 against the bottom end edge of the adjustment screw 62. The top sleeve 28 is held in this position by the force from the helical spring 30 which is transmitted to the top sleeve 28 by means of the balls 57 and 58 and the bottom sleeve 29. The lever 26 extends substantially perpendicularly to the axis X, and there is no wedging of the thrust rod 15 in the central hole 27. The sheath is urged resiliently upwards by the spring 25. It is held inside the adjustment screw 62 by the contact part 41 coming into abutment against the bottom end of the screw.

Figure 5:
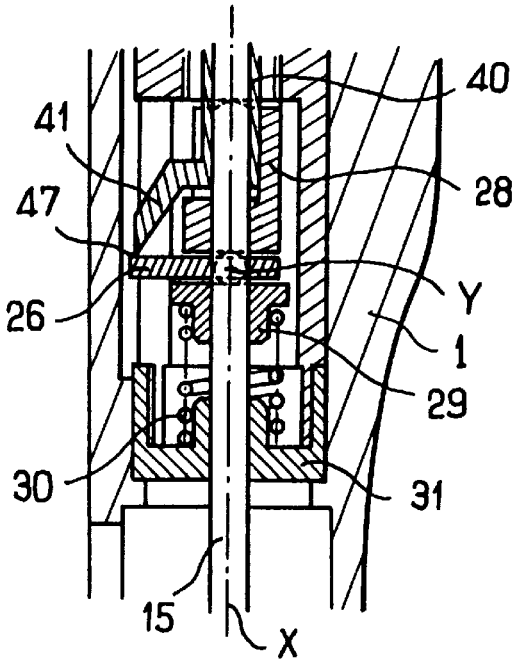
Figure 6:
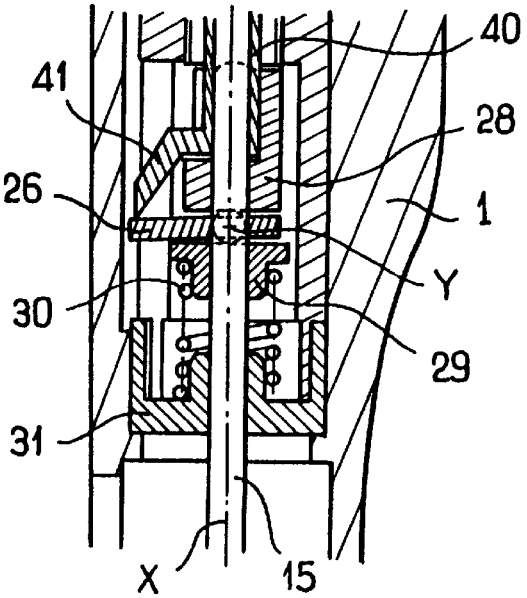
Figure 7:
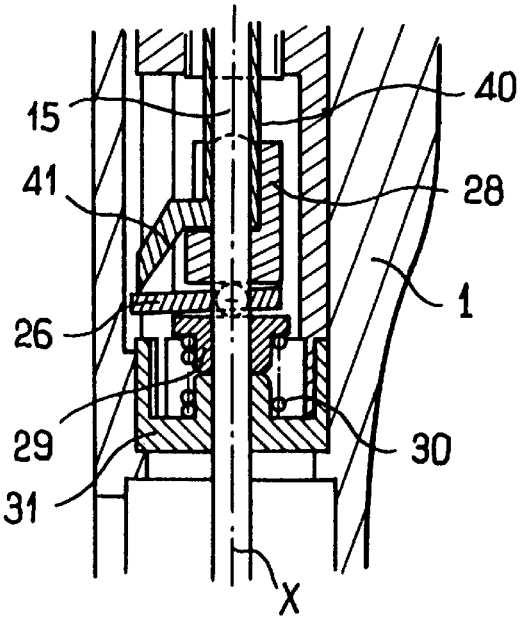

FIG. 5 shows the sheath 40 of the pusher 22 at the end of a first stroke referred to as a "comfort" stroke, extending over a distance B from the rest position of the sheath 50 until the edge 47 comes into contact with the leer 26. When the user continues to press on the pushbutton 23, i.e. beyond the end of the comfort stroke, the lever 26 is caused to tilt about the axis Y until the thrust rod 15 wedges within the central hole 27. As mentioned above, the tilting movement takes place about the axis Y without sliding over the thrust rod 15. Therefore, the bottom sleeve 29 does not move during tilting of the lever 26. When the user presses further on the pushbutton 23, the sheath 40 acts via the contact part 41 to drive the lever 26 downwards, and the movement of the lever is accompanied by movement of the thrust rod 15 because the thrust rod is wedged in the central hole 27. The downward movement of the lever 26 is transmitted to the bottom sleeve 29 by the balls 57 and 58, and the sleeve moves downwards against the helical spring 30 until the bottom end edge 70 of the bottom sleeve 29 comes into abutment against the plane top end edge 71 of the central portion 33 of the ring 31, which edge extends generally perpendicularly to the axis X. The thrust rod 15 has moved down through a distance A corresponding to the initial distance between the bottom end edge 70 of the bottom sleeve 29 and the top end edge 71 of the central portion 33 of the ring 31. As it moves downwards, the thrust rod 15 entrains the piston rod 5, and a predetermined volume of liquid is expelled through the orifice 4'. When the user releases pressure on the pushbutton 23, the lever 26 moves back up on its own, independently of the thrust rod 15, because there is no wedging between the thrust rod and the hole 27 when the contact part 41 is not exerting pressure on the end 48. The helical spring 30 returns the lever 26 towards its rest position, which corresponds to the top sleeve 28 coming into abutment against the bottom end edge 61 of the adjustment screw 62.

By acting on the adjustment screw 62, the user can alter the initial distance between the bottom end edge 70 of the bottom sleeve 29 and the top end edge 71 of the central portion 33 of the ring 31, and thus can alter the distance A and the volume which will be dispensed on the next occasion that pressure is exerted on the pushbutton 23.

Figure 8:
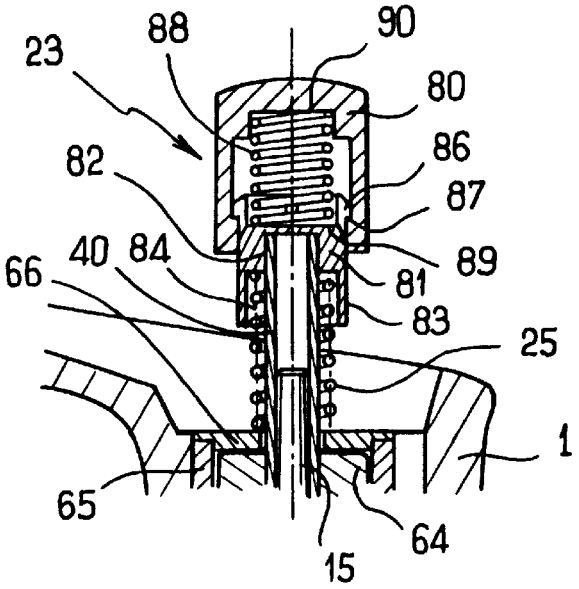
FIGS. 8 to 10 show successive positions of the pushbutton fitted to the pusher of the pipette while the pipette is in use.
Figure 9:
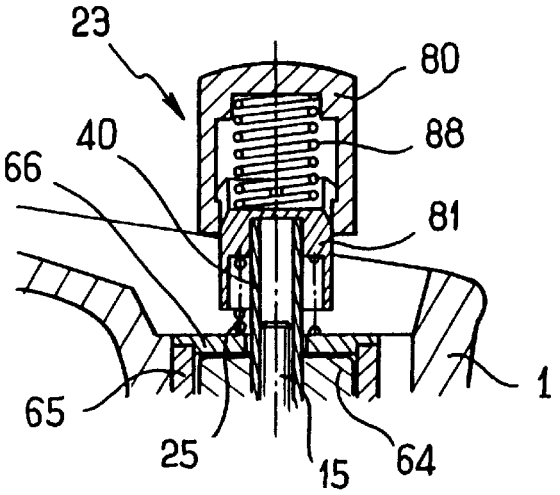
Figure 10:
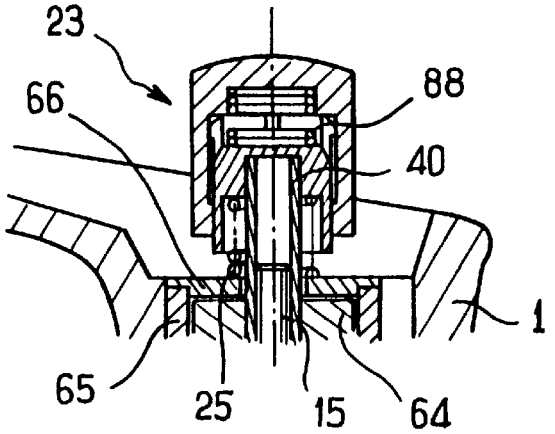

As shown more particularly in FIGS. 8 to 10, the pushbutton 23 preferably comprises two portions that are assembled together telescopically. More precisely, the pushbutton 23 includes a bottom portion 81 having a bore 82 for engaging on the top end edge of the sheath 40 until the sheath comes into abutment against the end of the bore 82. Externally, the bore 82 is surrounded in a downward direction by a cylindrical wall 83 that co-operates with the sheath 40 to form a downwardly open annular groove 84 for receiving the top end of the spring 25. The spring operates in compression and is interposed resiliently between the bottom of the groove 84 and the closure washer 66 having the sheath 40 passing through the center thereof. The pushbutton 23 also includes a top portion 80 which is mounted to slide along the axis X over the bottom portion 81. The bottom portion is provided with retaining tongues 86 at its top end, each of which has an outwardly projecting tooth suitable for coming into abutment against a shoulder 87 formed on the radially inner surface of the top portion 80 so as to retain it axially. A helical spring 88 operating in compression is mounted inside the top portion 80 to be interposed resiliently between the top front face 89 of the bottom portion 81 and the bottom 90 of the top portion 80, and to urge the top portion resiliently upwards until the teeth of the tongues 86 come into abutment against the shoulder 87.

Before using the pipette, the syringe 2 is filled with a liquid to be dispensed by immersing the frustoconical endpiece 4 in the liquid to be taken, and then manually moving the piston rod 5 up into the receptacle 10 by means of the drive finger 13. The thrust rod 15 moves up freely inside the sheath 40 of the pusher 22, since the lever 26 is in its rest position.

To dispense a predetermined volume of liquid, as selected by rotating the collar 64 and as indicated by the drums of the display assembly 21, the user presses on the top portion 80 of the pushbutton 23. The thrust force is transmitted via the spring 88 to the bottom portion 81, and thus to the sheath 40, which sheath moves downwards until the bottom sleeve 29 comes into abutment against the ring 31. The spring 25 for returning the sheath 40 to its rest position is then compressed. If the user continue to press on the pushbutton 23, the top portion 80 covers the bottom portion 81 as shown in FIG. 10. The user only becomes aware that the spring 88 is compressed after the bottom sleeve 89 has reached the ring 31. This ensures that the user pushes the pushbutton 23 over a distance that is sufficient to ensure that the pushrod 15 is driven downwards over the entire stroke A. When the user begins to release the pushbutton 23, the bottom sleeve 29 remains in abutment for the length of time taken by the spring 88 to relax. This limits jerking on the pushrod 15 and ensures that the entire volume of liquid to be dispensed is indeed delivered. The stiffness constant of the spring 88 is greater than those of the springs 25 and 30. The stiffness constant of the spring 25 is greater than that of the spring 30.

Finally, the invention makes it possible to obtain constant accuracy for the pipette, in spite of wear affecting the central hole 27 and the thrust rod 15. It is not limited to the embodiment described. In particular, it is possible to modify the fixing of the syringe 2 relative to the housing 1 and the means for providing a connection between the piston rod 5 and the thrust rod 15.

Figure 11:
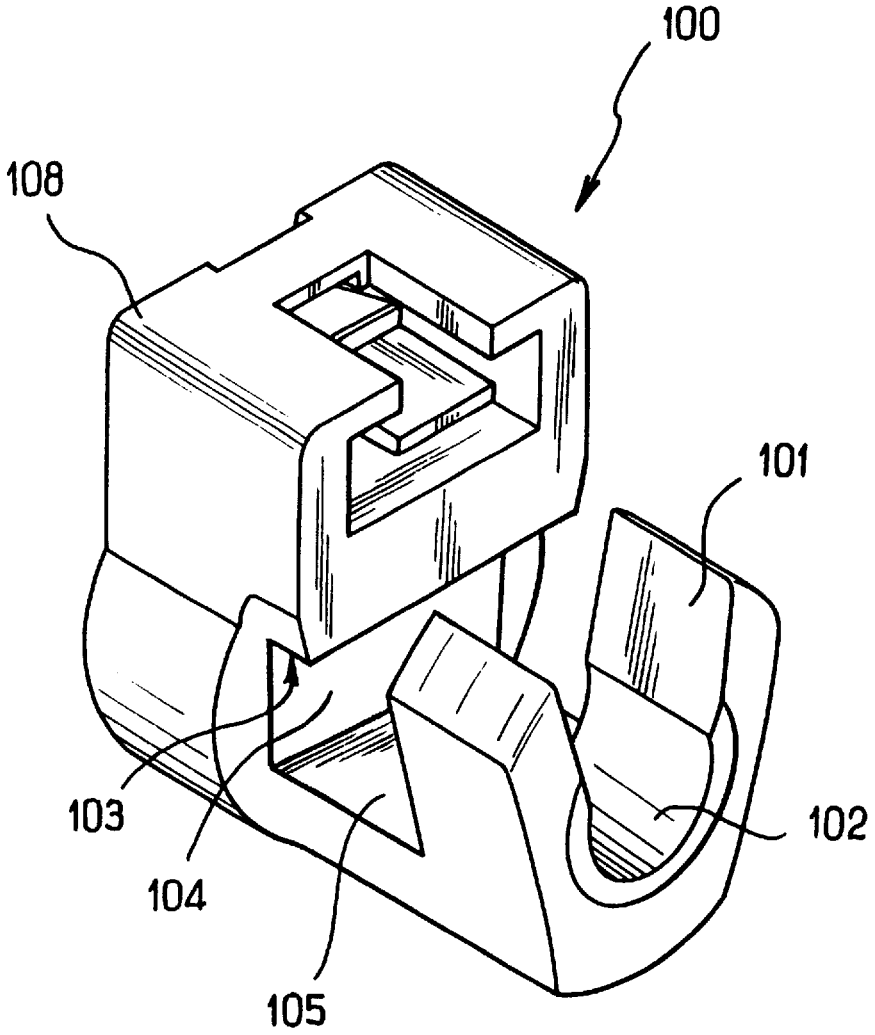
FIG. 11 is a perspective view of a clamp for fixing the piston tail.
Figure 12:
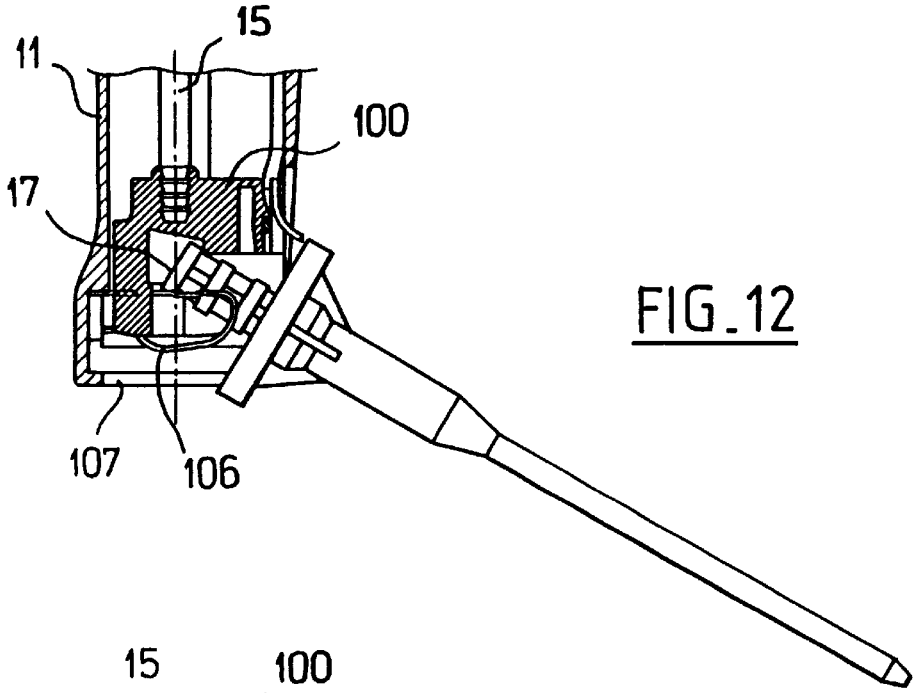
FIGS. 12 and 13 show how the syringe-piston assembly is put into place by pivoting.

FIG. 11 is a perspective view of a particularly advantageous embodiment of fixing means for fixing the assembly comprising the syringe 3 and the piston rod 5 to the bottom end of the housing 1 of the pipette. It comprises a clamp 100 specially designed to enable the bottom portion of the pipette to be installed and replaced quickly. The clamp 100 is constituted by a solid part disposed at the bottom end of the housing 1 of the pipette in the position shown by the sections of FIG. 1*a* and of FIGS. 12 and 13. It comprises an open portion provided with two resilient branches 101 that open to the outside to facilitate guidance and to enable the end of the piston rod 5 to be inserted. The bottom faces of the two resilient branches 101 are connected together by a cylindrical surface 102 in which the tail of the piston rod 5 is held.

In practice, it is advantageous to use a cylindrical surface whose inside diameter is slightly greater than that of the outside surface of the tail of the piston rod, by about 1/10th of a millimeter. As shown in FIG. 11, the resilient branches 101 are located in the bottom portion of the clamp 100 whose middle portion includes a recess designed to enable the piston tail to be-mounted and dismounted. This recess is defined by three generally plane surfaces which are essential for providing mounting and retention of the piston tail described above in greater detail. Adjacent the opening between the branches 101, there is a shoulder surface 103 which is constituted by a small plane surface extending on the longitudinal axis of the pipette and serving as a hooking and bearing surface for the top friction disk 17 on the tail of the piston rod 5. The hooking function of the shoulder surface 103 is illustrated by the position of the piston syringe assembly shown in FIG. 12. This is the position for the piston syringe assembly for insertion, which takes place laterally with the assembly inclined relative to the bottom of the pipette housing. The piston assembly is put finally into place merely by pivoting said assembly so as to bring it into alignment with the pipette. For this purpose, the clamp 100 includes a transverse surface 104 that is not accurately perpendicular to the axis X of the pipette, but that slopes by a few degrees relative thereto, thus establishing a set-back that allows the top disk 17 of the piston rod 5 to pivot. This surface is thus therefore not properly speaking an abutment or a thrust surface.

Figure 13:
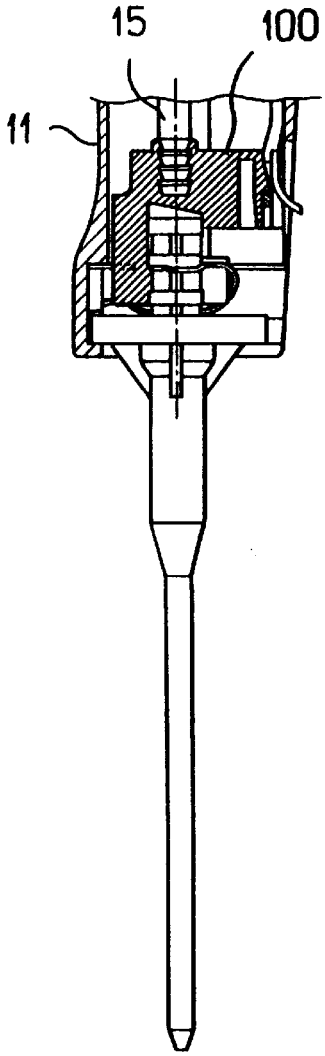

Finally, on the side opposite to the opening of the branches 101, the middle portion of the clamp 100 includes a longitudinal surface 105 for bearing transversely against the tail of the piston rod. It can be seen in FIG. 13 that, after the piston and syringe assembly has tilted, the various friction disks 17 come into contact with said surface 105 along one of their generator lines. Naturally, to improve retention, the pipette also includes a metal clamp 106 of appropriate resilience that locks the bottom portion of the pipette in its proper working position, as shown in FIG. 13. The essential function of the clamp 106 is to hold the syringe 2 pressed against the bottom support collar 107 of the pipette housing, while the piston rod 5 is free to move together with the clamp 100 inside the receptacle 10 of the pipette.

The top portion 108 of the clamp 100 includes means for securing it to the top end of the thrust rod 15 to control longitudinal displacements of the assembly comprising the clamp 100 and the piston 5 within said receptacle 10 of the pipette.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A pipette for dispensing successive volumes of liquid by repeated action on a pushbutton (22), the pipette comprising:

a housing (1) of oblong shape, incorporating an adjustment mechanism for adjusting the volume of liquid to be dispensed;

a syringe (2) for mounting removably to one end of the housing (1), comprising a syringe body (3) provided with a fluid-passing orifice (4') and a piston rod (5) mounted to move inside said syringe body (3);

a thrust rod (15) mounted to slide longitudinally in the housing, and to be removably connected at one end to said piston rod (5);

a drive lever (26) for driving the thrust rod (15) and the piston rod (5) solely towards said liquid-passing orifice (4'), the lever (26) extending transversely to a longitudinal axis (X) of the thrust rod (15) and being provided with a hole (27) through which the thrust rod (15) passes with an amount of clearance, the lever (26) also being mounted with the ability to move inside the housing over a stroke that is adjustable in a direction along the longitudinal axis (X) of the thrust rod (15) between a rest position defined by an adjustable abutment of the adjustment mechanism and an end-of-stroke position defined by a fixed abutment (31), and being returned towards said rest position by resilient return means (30); and a pusher (22) being mounted to slide longitudinally inside the housing, being provided at one end extending outside the housing with a pushbutton (23) and being capable of acting via its other end on the lever (26) to tilt it obliquely relative to the thrust rod (15) and then by wedging the thrust rod (15) to drive the thrust rod (15) towards the fluid-passing orifice (4') together with the piston rod (5) so as to expel a predetermined volume of liquid as defined by the stroke of the lever (26) between said rest position and said end-of-stroke position, return movement of the lever (26) towards its rest position after each action on the pusher (22) taking place under drive from said resilient return means (30) while the piston rod (5) retains its position within the body (3) of the syringe (2), the pipette being characterized in that the lever (26), mounted to rotate about a tilt axis (Y) that intersects the axis of said hole (27) perpendicularly and substantially halfway along the hole, is disposed on the thrust rod (15) between a bottom sleeve (29) and a top sleeve (28) slidably mounted on the thrust rod (15), and wherein said lever has two surfaces of revolution centered on said tilt axis (Y), said surfaces being disposed on either side of said hole (27) and being in contact with the top and bottom sleeves (28, 29), the bottom sleeve (29) coming into abutment against said fixed abutment (31) when the lever (26) reaches its end-of-stroke position.

2. A pipette according to claim 1, characterized in that said surfaces of revolution are formed by balls (57, 58) crimped in holes (55, 56) through the lever (26).

3. A pipette according to claim 2, characterized in that said pusher (22) includes a sheath (40) slidably mounted inside the housing and within which the thrust rod (15) is free to slide, and wherein the sheath (40) is provided at one end with a contact piece (41) having a sharp edge (47) designed to press on the lever (36) to tilt the lever (26) about said tilt axis (Y) and then to move the lever (26) along the longitudinal axis (X) of the thrust rod (15).

4. A pipette according to claim 3, characterized in that the adjustment mechanism includes an adjustment screw (62) for rotating in order to adjust the stroke of the liver (26) and the volume dispensed each time the pusher (22) is actuated, said adjustment screw (62) having the sheath (40) and the thrust rod (15) passing through the inside thereof, and meshing with a volume-indicator mechanism (31), the adjustment screw (62) having an end edge (61) that defines said variable abutment, and wherein the top sleeve (28) has an end edge suitable for coming into point contact with the end edge (61) of the adjustment screw (62) defining said variable abutment.

5. A pipette according to claim 1, characterized in that the pushbutton (23) includes a first portion (80) slidably mounted over a second portion (81), with a first return spring (88) being interposed therebetween, a second return spring of stiffness constant smaller than that of the first return spring being resiliently interposed between the housing (1) and said second portion (81) to return the pusher (22) resiliently away from said liquid-passing orifice (4'), the stiffness constant of said resilient return means (30) urging the lever (26) towards its rest position being smaller than the stiffness constants of the first and second return springs (88).

6. A pipette according to claim 1, characterized in that the syringe (2) and the piston rod (5) are removably fixed to the housing (1) of the pipette by means of a clamp (100) in the form of a part whose top portion (108) is secured to a bottom end of the thrust rod (15), whose middle portion includes a recess suitable for receiving a free top end of the piston rod (5), and whose bottom portion includes resilient branches (101) enabling the piston rod (5) to be inserted therein and to be held thereby, and wherein a bottom end of the housing includes means (106, 107) suitable for removably securing the body (3) of the syringe (2) while leaving the clamp (100) and the piston rod (5) free to slide.

7. A pipette according to claim 6, characterized in that the middle portion of the clamp (100) includes a recess defined by free top faces of the branches 101, by a transverse surface (104) and by a longitudinal surface (105).

* * * * *